United States Patent [19]

Zarrineghbal et al.

[11] Patent Number: 4,643,820

[45] Date of Patent: Feb. 17, 1987

[54] PROCESS FOR ENHANCING THE CETANE NUMBER OF DIESEL FUEL

[75] Inventors: Hossein Zarrineghbal; James R. Kittrell; Saeed T. Darian, all of Amherst, Mass.

[73] Assignee: OxiProcessing, Concord, Mass.

[21] Appl. No.: 832,196

[22] Filed: Feb. 24, 1986

[51] Int. Cl.[4] ..... C10G 29/02

[52] U.S. Cl. ..... 208/222; 208/15; 208/207; 208/219; 208/223; 208/224; 208/236; 208/289; 44/57; 44/72

[58] Field of Search ..... 208/221, 222, 223, 236, 208/207, 15, 289; 44/57, 72

[56] References Cited

U.S. PATENT DOCUMENTS

| | | | |
|---|---|---|---|
| 2,104,919 | 1/1938 | Whitney | 44/54 |
| 2,184,440 | 12/1939 | Shoemaker et al. | 208/15 |
| 2,333,817 | 11/1943 | Proell | 44/57 |
| 3,135,680 | 6/1964 | Fierce et al. | 208/15 |
| 3,164,546 | 1/1965 | Millikan et al. | 208/15 |
| 3,244,618 | 4/1966 | Dimond et al. | 208/206 |
| 3,847,800 | 11/1974 | Guth et al. | 208/236 |
| 4,398,505 | 8/1983 | Cahill | 44/57 |
| 4,485,007 | 11/1984 | Tam et al. | 208/236 |
| 4,585,461 | 4/1986 | Gorman | 44/57 |

FOREIGN PATENT DOCUMENTS

| | | | |
|---|---|---|---|
| 0491648 | 9/1938 | United Kingdom | 44/72 |

*Primary Examiner*—Andrew H. Metz
*Assistant Examiner*—Anthony McFarlane
*Attorney, Agent, or Firm*—Sughrue, Mion, Zinn, Macpeak, and Seas

[57] ABSTRACT

A process for enhancement of the cetane number of a diesel fuel which in one embodiment comprises:

(1) treating a diesel oil with a nitrogenous treating agent in a nitrogen amount, equivalent on a 100% nitric acid basis, to about 10 weight percent or less of the diesel oil feed;

(2) removing unreacted nitrogenous treating agent from the diesel oil of step (1) to produce a treated diesel oil, and;

(3) blending the treated diesel oil of step (2) with an untreated diesel oil to produce a blended diesel fuel such that the added nitrogen content in the blended diesel fuel is (a) about 300 ppm or less of nitrogen added when the diesel oil treated in step (1) is obtained from virgin diesel oil stock; or (b) about 450 ppm or less of nitrogen added when the diesel oil treated in step (1) is obtained from hydrotreated diesel oil stock.

38 Claims, 4 Drawing Figures

DEPENDENCE OF STABILITY ON NITROGEN ADDED

AVERAGE BLENDING CETANE NUMBERS OF TREATED PRODUCT
WHICH MEET R.B. CARBON AND STABILITY
REACTOR FEED CETANE = 41

CALCULATED BLEND CETANE OF TREATED PRODUCT BLENDS FROM CURVE THRU DATA OF FIGURE 3

PROCESS FOR ENHANCING THE CETANE NUMBER OF DIESEL FUEL

FIELD OF THE INVENTION

This invention provides a process for upgrading a diesel oil by treatment of a diesel oil with a nitrogenous agent to increase the cetane rating thereof, and blending the treated oil with an untreated diesel oil to obtain in the diesel fuel blend a cetane increase, good stability and acceptable levels of Ramsbottom carbon. More particularly, in the present process, the extent of nitrogen addition to the treated diesel oil used in the diesel fuel blend and the blend ratio of treated to untreated diesel oil are controlled in one embodiment to insure that the concentration of added nitrogen in the final blended diesel fuel product does not exceed about 300 ppm in the case of virgin diesel oil stocks, or about 450 ppm in the case of hydrotreated diesel oil stocks.

BACKGROUND OF THE INVENTION

It has long been known that the cetane number of diesel oils can be improved either by adding a nitrogen-containing fuel additive, or by oxidation with a nitrogenous oxidizing agent. Oils in the diesel boiling point range having the proper physical characteristics such as pour point, cloud point, viscosity and volatility can be obtained by nitrating the diesel fraction in order to increase the cetane number. However, it is well known that the nitration of such oils tends to increase the Ramsbottom carbon content and to decrease to stability of the fuels by forming an insoluble sediment. The insoluble sediment produces a haze and eventually a deposit while the fuels are in storage. While many attempts to eliminate the disadvantage of poor stability characteristics have been made and solvent extraction, including alkali scrubbing, has been employed to improve stability, conventional solvent extraction has proven unsatisfactory to provide acceptable stability in the case of nitrogen-treated fuels.

Solvent extraction with certain organic solvents, such as those described in copending U.S. patent application Ser. Nos. 832,612, filed 2/24/86 (attorney's Docket No. A-4963) and 832,197, filed 2/24/86 (attorney's Docket No. A-4962) is effective to improve stability and reduce Ramsbottom carbon content, but a major portion of the cost of upgrading diesel oil by this method is incurred in the solvent extraction process. A method of improving the cetane rating of substandard diesel oils that does not require an expensive solvent extraction step to meet diesel fuel product specifications for stability and Ramsbottom carbon is particularly desirable.

It is known to enhance the cetane number of diesel oil using oxidative processes. Regarding the use of nitration to improve the cetane number of diesel oils, British Pat. No. 491,648 teaches contacting a diesel oil with a nitrating agent in order to increase its cetane number. The disclosure in British Pat. No. 491,648 is that the nitrated oil can be used alone or in a blend with untreated diesel oil. Extraction with solvents including acetone, methyl and ethyl alcohols, ethylene dichloride and aniline is described for obtaining concentrates of nitrated petroleum components. However, by contacting a diesel oil with a nitrating agent, stability is decreased and Ramsbottom carbon is increased, and these deficiencies are combined with poor process yields when the product is extracted using the solvents disclosed. While recognizing the problem of sedimentation and poor stability, this British Patent contains no suggestion as to how these problems can be reduced or eliminated.

U.S. Pat. No. 3,135,680 discloses oxidation of a sour petroleum fraction with nitrogen dioxide followed by washing with water and alkali, to desulfurize diesel oils and improve cetane. The disclosure is that the product obtained, however, tends to have an objectionable color resulting from the nitrogen dioxide treatment, and subsequent sulfuric acid treatment, vacuum distillation or clay treating is considered essential to completely remove materials formed during oxidation. Unfortunately, this reduces or eliminates the increase in cetane number. Due to its high Ramsbottom carbon content, the product of this process forms substantial coke in the still upon distillation.

A process is described in U.S. Pat. No. 3,164,546 for producing diesel fuels having improved cetane number and odor, by treating the oil with nitrogen dioxide, washing with aqueous alkali and/or solvent extraction, followed by a water wash. Solvents disclosed as suitable for the solvent extraction step are nitromethane, dimethylformamide, pyridine, acetonitrile, glycolonitrile, ethylene glycol, ethanolamine and phenol. No reference is made, however, to the important stability and Ramsbottom carbon content specifications, which are by far the most difficult product specifications to meet for a diesel fuel product when employing nitrogenous treating agents. Furthermore, extraction reduces yields of product.

U.S. Pat. No. 2,333,817 discloses oxidation of diesel oils by nitrogenous compounds followed by hexane dilution and filtering to improve cetane and prevent sediment formation. Such a product does not pass present-day industry standard for stability (although haze formation is reduced) and it does not meet Ramsbottom carbon specifications. From the exemplification it appears this technique is only applicable to cycle oils.

These methods have generally apparently employed nitration or an oxidation treatment for cetane improvement of diesel oils, but it is also known that the cetane number of diesel oils can be increased by adding various nitrated hydrocarbon derivatives to the oils, including amyl nitrate, octyl nitráte, and the nitrate ester "dopes" disclosed in British Pat. No. 491,648. Other nitrogen-containing additives for improving cetane are disclosed in U.S. Pat. No. 4,398,505. Use of these derivatives is disadvantageous since they are expensive and must be separately prepared, handled and stored.

U.S. Pat. No. 2,184,440 relates to methods of increasing the cetane number of blended diesel fuels by blending diesel fuels from different sources, one of which is a high sulfur crude, and treating the blended fuel with sodium plumbite and a large excess of elemental sulfur. Alternatively, a distillate fuel stock can be treated with sodius plumbite and an excess amount of elemental sulfur over that required to sweeten the stock, and distilled to obtain a sweetened condensate, with the bottoms being further reduced and added to an untreated diesel fuel to increase the cetane number of the blend. The reduced bottoms amounting to about 1 to 6% of the original distillate fuel stock are added in amounts of about 0.5 to 5% to diesel fuels to raise their cetane number, e.g., by 2 to 19 over untreated diesel fuel.

U.S. Pat. No. 2,104,919 provides a means to achieve a stabilized fuel by blending straight-run and cracked stocks. The disclosure of this patent states that typically fuel oils produced by blending straight run components and cracked residues have a tendency to form a carbonaceous sludge on storage, and the precipitation of sludge in such fuels containing 10 to 80% heavy cracked residues is inhibited by mildly oxidizing the straight-run component before blending, e.g., by blowing air at 250°–400° C. therethrough for ½ to 12 hours.

U.S. Pat. No. 2,317,968 discloses a diesel fuel containing substantial portions of chemically combined reactive oxygen through treatment with air, oxygen or an oxygen carrying gas, to produce by partial oxidation a petroleum fuel having a volatility greater than that of kerosene and relatively free from asphaltic and resinous components and from large proportions of aromatics, to an "oxygen factor" of 800 to 1450 by air blowing, removal of acids produced by oxidation, and blending with a diesel fuel to produce a diesel fuel blend having increased cetane. Blends of 2.5% oxidized oil to 97.5% by volume sulfur dioxide-treated petroleum distillate and of 20% by volume of oxidized oil to 80% by volume of a clean gas oil distillate are disclosed.

U.S. Pat. No. 2,365,220 discloses a method similar to that of U.S. Pat. No. 2,317,968. The disclosure is of the preparation of a diesel fuel, in which a diesel fuel of predominately paraffinic character is oxidized using air, oxygen or an oxygen carrying gas to produce an oil having an "oxygen factor" of higher than 5, acidic reaction products are removed, and the resulting oxidized stock is blended with from 2/5 to 20 times its volume of a clean diesel petroleum hydrocarbon distillate.

U.S. Pat. No. 2,521,698 discloses that the fuels produced by the methods of U.S. Pat. Nos. 2,317,968 and 2,365,220 are unstable and corrosive, and that the stability and corrosiveness of such cetane-enhanced diesel fuels can be improved with a loss of about 25% of cetane enhancement, by subjecting the oxidized diesel fuel to acid treatment with a strong acid, such as sulfuric or nitric acid, in a concentration of at least 0.1 pound per gallon of oxidized stock, followed by alkali wash and blending of the treated oxidized stock with diesel fuel. A concentrated oxygenated cetane-improving additive is also disclosed, prepared from the bottoms of the distilled oxidized diesel stock.

U.S. Pat. No. 4,280,818 discloses oxidizing a hydrocarbon oil with aqueous nitric acid in a weight ratio of about 1:0.1 to 1:10 of hydrocarbon to acid and separating the aqueous phase from the oxidized hydrocarbon phase. The disclosure is that the oxidized hydrocarbon phase can be extracted and the product obtained blended with a polar solvent to produce a fuel mixture.

U.S. Pat. No. 3,284,342 discloses oxidation of residue using a number of oxidants including nitrogen oxides, followed by a thermal treatment to reduce the sulfur content of the residue, in which both steps can be promoted with catalysts. When applied to diesel oil, this process produces substantial carbonaceous deposits in the thermal treating still, and is unsatisfactory for commercial use.

U.S. Pat. No. 3,135,680 discloses a process for refining petroleum fractions in the diesel oil boiling range to produce diesel fuel with enhanced cetane number and odor by treating the fractions with nitrogen dioxide followed by a clay treatment to remove odor.

A process of deodorizing and desulfurizing light petroleum distillates by treatment with nitrogen dioxide followed by alkali wash and water wash is disclosed in U.S. Pat. No. 3,267,027. This process is unsuitable for producing diesel fuels of acceptable stability and Ramsbottom carbon content.

U.S. Pat. No. 3,244,618 discloses a process for sweetening petroleum hydrocarbons by treating the hydrocarbon fraction with molecular oxygen in the presence of a catalytic amount of a nitrogen oxide. Application of this process to diesel fuel results in a product with inferior cetane enhancement.

U.S. Pat. No. 2,004,849 discloses the use of an oxidant, hydrogen peroxide, in combination with sulfuric acid to effect sulfur removal from hydrocarbons, without substantial loss of aromatics. However, this process is ineffective for improving the cetane of diesel fuel.

Processes for treating petroleum stocks by oxidation followed by solvent extraction have been described for various purposes.

For example, a process for producing a fuel composition by oxidizing a hydrocarbon oil with aqueous nitric acid, followed by extraction with acetone, methyl ethyl ketone, cyclohexanone, methanol, ethanol, normal propanol, isopropanol, ethyl acetate, tetrahydrofuran, dioxane, or a combination of an alcohol and a ketone, an alcohol and water, a ketone and water or a combination of alcohols is disclosed in U.S. Pat. No. 4,280,818.

Although the oxidation/extraction methods described above have met with some success in improving petroleum diesel fuels, the known approaches toward oxidation to remove a portion of the original sulfur content as gaseous sulfur oxides, and to convert a portion of the original sulfur content into sulfoxides and/or sulfones followed by extraction with appropriate solvents to achieve a desired low sulfur raffinate have not completely eliminated problems of instability and unacceptable Ramsbottom carbon for diesel fuels, and have the disadvantage of an expensive solvent extraction step, resulting in low yields.

The methods described above when applied to petroleum stocks for use as diesel fuels basically have the disadvantages that (a) oxidative desulfurization methods involving nitrogenous oxidizing agents often result in increased gum and sedimentation, and reduce the stability of the fuels produced, (b) the oxidatively treated fuels are not useful as diesel fuel blendstocks due to poor stability and high Ramsbottom carbon content, and (c) solvent extraction, while effective to improve stability and Ramsbottom carbon content, is expensive and of low product yields in comparison to oxidative treatment alone where the oxidized product alone can be blended to improve diesel fuels.

While many conventional methods of improving diesel cetane number by oxidation with nitrogenous oxidizing agents exist, they are generally inadequate to meet other product specifications. Particularly, diesel fuels produced by nitrogeneous oxidation and solvent extraction can in some cases meet sulfur and cetane requirements for fuels, but are unsatisfactory with respect to the important specifications of stability and Ramsbottom carbon content. Processes employing sulfuric acid or clay in conjunction with nitrogeneous oxidizing agents are ineffective to retain a high cetane rating when practiced to control Ramsbottom carbon and stability. Distillative methods are commercially unfeasible due to the presence of substantial carbonaceous deposits in the still, and when thermal treating is applied to diesel fuel to reduce sulfur content of the residue, this process also produces substantial carbonaceous deposits in the thermal treating still.

Apart from the failure of conventional oxidative cetane enhancement methods to provide diesel fuels of sufficient stability and Ramsbottom carbon content, these methods, like the oxidative desulfurization methods, employ solvents which result in poor yields, requiring unacceptably high solvent-to-oil ratios. Alternatively, the solvents used in some methods reduce or entirely eliminate the advantage of cetane enhancement obtained by oxidation.

While certain of the patents cited above refer to oxidation of diesel stocks to improve cetane, and the use of such oxidatively enhanced stocks in blends with unoxidized diesel fuels, these patents fail to recognize the importance of limiting the nitrogen content of the final blend to achieve acceptable stability or Ramsbottom carbon content in the final blend. Furthermore, there is no appreciation of the remarkable increase of cetane in the treated portion and in the final blend when nitrogen treatment and blending are controlled according to the present process.

SUMMARY OF THE INVENTION

An object of the invention is to provide a process for enhancing the cetane number of a diesel fuel.

Another object of the invention is to provide a process for increasing the cetane number of a diesel fuel comprising simply treating the diesel oil with a nitrogenous treating agent and then blending the treated diesel oil with an untreated diesel oil in specific proportions to produce a blended diesel fuel having an unexpectedly increased cetane number.

A further object of this invention is to provide a blended diesel fuel with improved cetane number and appropriate stability and Ramsbottom carbon.

In one embodiment of this invention, this invention provides a process for the enhancement of the cetane number of a diesel fuel comprising:

(1) treating a diesel oil with a nitrogenous treating agent in a nitrogen amount, equivalent on a 100% nitric acid basis, to about 10 weight percent or less of the diesel oil feed;

(2) removing unreacted nitrogenous treating agent from the diesel oil of step (1) to produce a treated diesel oil; and (3) blending the treated diesel oil of step (2) with an untreated diesel oil to produce a blended diesel fuel such that the nitrogen added content in the blended diesel fuel is (a) about 300 ppm or less of nitrogen added when the diesel oil treated in step (1) is obtained from virgin diesel oil stock, or (b) about 450 ppm or less of nitrogen added when the diesel oil treated in step (1) is obtained from hydrotreated diesel oil stock.

In a further embodiment of this invention, this invention provides a process for the enhancement of the cetane number of a non-fungible diesel fuel comprising:

(1) treating a first diesel oil with a nitrogenous treating agent in a nitrogen amount, equivalent on a 100% nitric acid basis, to about 10 weight percent or less of the diesel oil feed;

(2) removing unreacted nitrogenous treating agent from the diesel oil of step (1); and (3) blending the treated diesel oil of step (2) with a secnd diesel oil which has not been treated as in step (1) above to produce a blended diesel fuel such that the nitrogen added content in the blended diesel fuel is about 1,000 ppm or less of nitrogen added, and wherein the first diesel oil treated in step (1) and/or the second diesel oil blended in step (3) is a non-fungible diesel fuel.

BRIEF DESCRIPTION OF THE ACCOMPANYING DRAWINGS

DETAILED DESCRIPTION OF THE INVENTION

Figure 1:
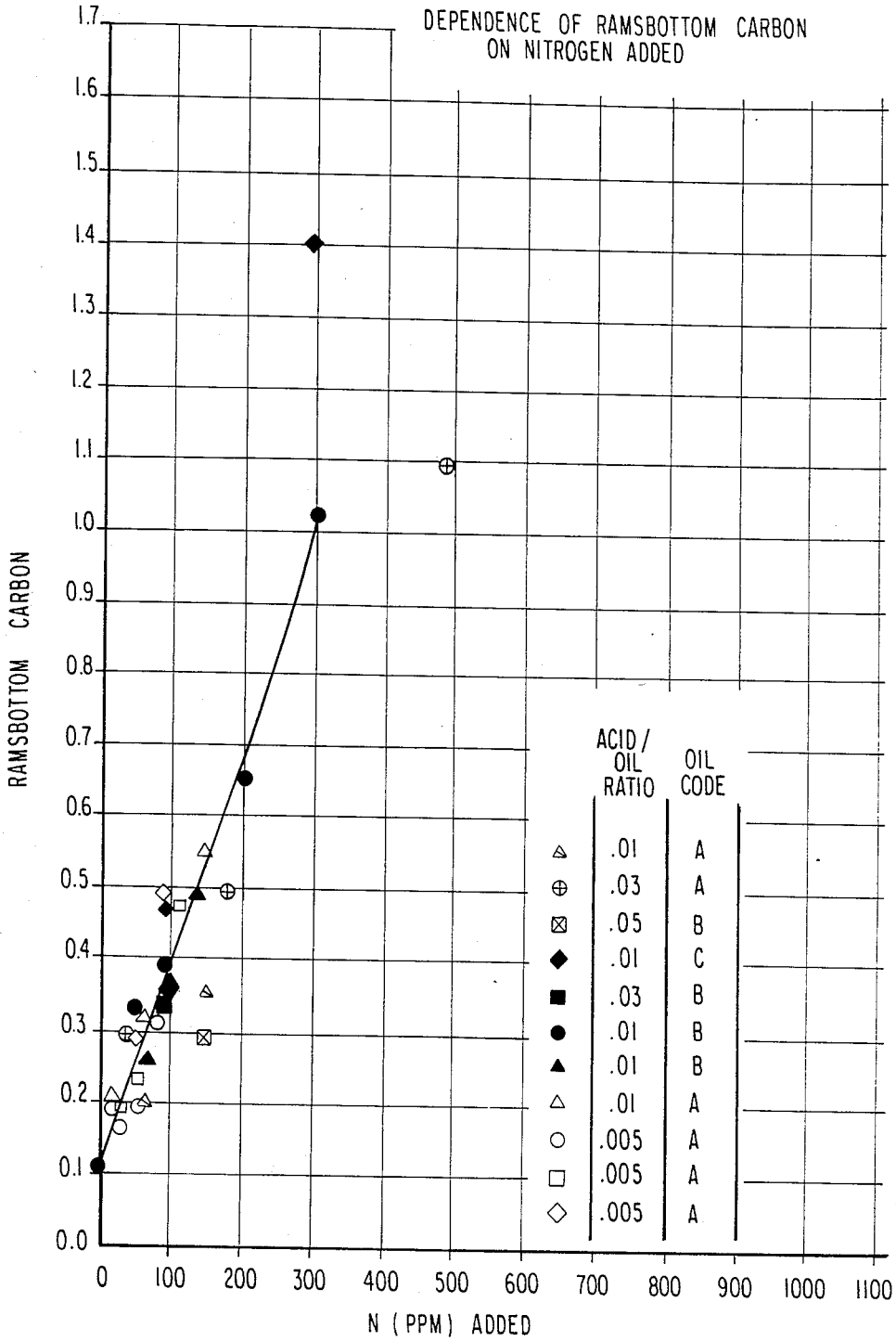
FIG. 1 is a graph showing the relationship between Ramsbottom carbon and nitrogen added to the diesel oil blend.

As indicated above, the process of this invention involves enhancement of the cetane number of a diesel fuel. The process basically comprises:

(1) treating a diesel oil with a nitrogenous treating agent in a nitrogen amount, equivalent on a 100% nitric acid basis, to about 10 weight percent or less to the diesel oil feed;

(2) removing unreacted nitrogenous treating agent from the diesel oil of step (1); and (3) blending the treated oil of step (2) with a diesel oil which has not been so treated as in step (1) to produce a blended diesel fuel such that the nitrogen added content in the blended diesel fuel (a) is about 300 ppm or less of nitrogen added when the diesel oil treated in step (1) is a diesel oil obtained from virgin diesel oil stock, or (b) is about 450 ppm or less of nitrogen added when the diesel oil treated in step (1) is a diesel oil obtained from hydrotreated diesel oil stock.

In the first step of the process of this invention, a diesel oil is treated by contacting such with a nitrogenous treating agent in a nitrogen amount equivalent to about 10 weight percent or less on the diesel oil feed of nitric acid based on the nitrogen content of a 100% concentration nitric acid.

If desired, the feed oil can first be subjected to pretreatment, such as by washing to remove phenols or other corrosive components of the oil, filtering to remove gum or sediment, heating or treatment with $H_2SO_4$ as conventionally used. In the first step of the process of the invention, the treating agent is a nitrogenous treating agent. The term "nitrogenous treating agent" is used herein to mean any known nitrogen-containing oxidizing compound including, e.g., a gas containing at least one nitrogen oxide with more than one oxygen atom for each nitrogen atom, a liquid containing at least one nitrogen oxide with more than one oxygen atom for each nitrogen atom, nitric acid and nitrous acid.

The treating gas used can be a gas containing only such a nitrogen oxide or can be one which contains mixtures of such nitrogen oxides. Furthermore, the treating gas can be one which also contains other components such as oxygen, nitrogen, lower nitrogen oxides, i.e., nitrogen oxides containing only one oxygen atom or less than one oxygen atom per nitrogen atom in the oxide. For efficiency, preferably the treating gas will be one which contains only nitrogen oxides with more than one oxygen atom for each nitrogen atom but mixtures with other gases such as oxygen, nitrogen, as well as inert gases such as air, helium and helium with air can be employed if desired. Suitably the treating gas will contain at least 0.5% by volume of at least one nitrogen oxide with more than one oxygen atom for each nitrogen atom, but the concentration can be reduced if the flow rate of treating agent is increased for a longer time. Nitrogen dioxide or its dimer $N_2O_4$ can be advantageously employed, alone or in a admixture with air.

The nitrogenous treating liquid used can be a liquid nitrogen oxide as defined above, nitric or nitrous acid either concentrated or in admixture with up to about 90% water by weight. Preferably the liquid nitrogenous treating agent is an aqueous solution of nitric acid containing about 50 to 90% by weight nitric acid.

However, the bove described concentrations, e.g., nitrogenous treating agent concentrations, are not limiting and are given merely for exemplification. Basically any concentration can be used as long as the nitrogenous treating agent is present in sufficient amounts to achieve in the blended product the nitrogen added amounts reacted for the process of the invention when the treated diesel oil is blended with the untreated diesel oil.

When liquid nitric acid is used as a nitrogenous treating agent in the present invention, it may advantageously be used in combination with other organic or inorganic acids. Suitable inorganic acids include sulfuric and phosphoric acids, and suitable organic acids include, e.g., acetic and formic acids. The organic and inorganic acid may be used alone or in combination. Typically, an inorganic acid can be added to the aqueous nitric acid solution used as a treating agent in an amount of from about 5 to 200% by weight of the nitric acid solution, and an organic acid can be added in an amount from about 5 to 200% by weight of the nitric acid solution. Preferred combinations of nitric and auxiliary acids include nitric and sulfuric, nitric and acetic, and nitric and formic acids.

When liquid nitrous acid is used as a nitrogenous treating agent in the present invention, it may advantageously be used in combination with other organic or inorganic acids. Suitable inorganic acids include sulfuric and phosphoric acids, and suitable organic acids include, e.g., acetic and formic acids. The organic and inorganic acid may be used alone or in combination. Typically, an inorganic acid can be added to the aqueous nitrous acid solution used as a treating agent in an amaount of from about 5 to 200% by weight of the nitrous acid solution, and an organic acid can be added in an amount from about 5 to 200% by weight of the nitrous acid solution. Preferred combinations of nitrous and auxiliary acids include nitrous and sulfuric, nitrous and acetic, and nitrous and formic acids. Mixtures of nitric acid and nitrous acid can also be used.

In the first step of the process of this invention, a diesel oil such as atmospheric gas oil is reacted with a nitrogenous treating agent in the form of a liquid or gas. The contacting of the diesel oil with the treating liquid can be accomplished by any means conventional in the art for contacting two liquid reactants, e.g., by injecting the acid mixture under the surface of agitated oil contained in a reactor. When a treating gas is employed, the treating gas can be contacted with the diesel oil using any conventional means for contacting a gaseous reactant with a liquid reactant. Suitable examples of such means for contacting a gaseous reactant with a liquid reactant include dispersing the gas as bubbles in the liquid, trickling the liquid over an inert solid bed with gas passing also over the bed co-currently or countercurrently to the liquid flow, the latter type flow being preferred.

It is important in the first step of the process of this invention to control the operating parameters during the reaction of the diesel oil with the treating gas or liquid to insure that the nitrogenous treating agent is employed in a nitrogen amount equivalent to about 10 weight percent or less, preferably 6 weight percent or less, more preferably 5 weight percent or less, of nitric acid based on the nitrogen content of 100% nitric acid. In accordance with the process of the present invention conducting step (1) in this manner results in a product of extremely high cetane value which may be advantageously blended into a diesel pool without deterious effects on Ramsbottom carbon and stability. This important processing control as to the reaction of the diesel oil with the nitrogenous treating agent is described in more detail below.

As used herein, the term "nitric acid equivalent-to-oil ratio" (acid-to-oil ratio, A/O) refers both to the weight of water-free nitric acid to the weight of diesel oil feedstock and to the weight of undiluted gaseous or liquid nitrogenous treating agent to the weight of diesel oil feedstock, and is from about 0.0002 to 0.10, preferably from about 0.0005 to 0.05, for the acids and from 0.0002 to 0.10, preferably 0.0005 to 0.05, for the nitrogen oxides. The control of the treatment may be achieved by controlling the water content of the acid in the reactor, by controlling the mixture of nitrogenous gas and air or inert gas used or by controlling temperature, time and degree of agitation. The treatment can also be controlled and improved by the copresence of sulfuric acid through its effect on water availability or other auxiliary acid mixed with the treating agent. This control of the amount of nitrogenous treating agent to the total weight of the deisel oil feed in step (1) can be easily maintained.

The reaction of the first step of the present invention can be performed at any temperature from about −40° to about 200° C., or less, most preferably from about 25° to 90° C. The reaction time is not particularly limited, and may include, for example, any time from about 1 minute to about 3 weeks. This first step of the present invention may be conducted at atmospheric pressure or at greater or lower pressures as desired. Advantageously, the reaction step is conducted using conventional agitation means, such as a stirrer.

Since a nitrogenous treating agent is used in the first step of the present ivention, typically an increase in nitrogen compound content over that originally present in the diesel oil will be observed. While not desiring to be bound by theory, the reason for the increase in observed nitrogen compound content is believed to be that nitration and esterification of the diesel oil substrate can occur resulting in an increase in the heteroatom nitrogen compound content.

Because of the complexity of the reactions involved, the treating agents may well do more than oxidize or nitrate compounds contained in the diesel oil in the process according to the invention. Hence, the first step is variously described herein as "nitrogenation" or simply "nitrogen treatment" or more simply "treatment", which refers to any reaction of the nitrogenous treating agent and diesel oil or its components, without limitation, and without reliance on any particular reaction or reaction mechanism.

Contact times on the order of less than about 120 minutes and weight ratios of nitrogenous treating agent to diesel oil feed of less than about 0.1 are desirable not only from the standpoint of efficiency but also from the standpoint of economics. Particularly preferably, a contact time of about 30 minutes in combination with a weight ratio of nitrogenous treating agent to diesel oil feed at about 0.05 or less can be advantageously employed for maximum yield of diesel oil with improved cetane rating and improved stability.

However, because of the known relationship of nitrogenous treating agent to cetane number, it is often advantageous when using a nitrogenous treating agent to carefully control the minimum amount of nitrogen compounds added to the diesel feed in order to insure a sufficient cetane number in the diesel fuel produced.

Depending on the nature of the nitrogenous treating agent employed, one skilled in the art can easily determine the amount of nitrogenous treating agent to use to ensure the proportion employed is a nitrogen amount equivalent to 10 weight percent or less nitric acid based on the weight of the diesel oil fed as a feed stock in step (1) of the process of this invention.

The process of this invention is applicable to the upgrading of diesel oil which can be derived from any source, for example, a conventional petroleum crude oil or crude oil fraction containing sulfure, aromatic, olefinic and naphthenic compounds as impurities. The term "diesel oil" as used herein is broadly defined to include any hydrocarbon having a nominal boiling range of about 350° F. to 700° F. which can be upgraded by the process of this invention to meet commercial specifications for a diesel fuel and the term "diesel fuel" is generally used to describe the upgraded product, although the terms can be used interchangeably.

The process of this invention is basically not limited in terms of the source of the diesel oil, but is applicable to any diesel oil from petroleum, coal, shale, tar sands, etc.

In the process for upgrading diesel oils according to the invention, particular product specifications may vary over a range. Based upon the disclosure contained herein, the present process may be readily applied and modified by one skilled in the art to produce a blended diesel fuel having particular desired specifications, particularly with respect to the basic criteria of cetane, stability, Ramsbottom carbon and sulfur content, density and boiling range. Furthermore, the process of this invention can be employed in combination with conventional techniques for meeting product specifications as desired, e.g., by addition of chemical additives such as corrosive inhibitors, stabilizers and the like.

Fuel stability is measured by a number of accelerated tests, one of which is the Nalco 300° F. test. For satisfactory stability in commercial storage and use, a transportation fuel must exhibit a Nalco rating of about 7.0 or lower. A rating of about 7.0 is the upper level of acceptability for commercial use, although a lower limit is desirable. The applicable Nalco test is well known in the art, and the test can be simply performed, for example, by placing 50 ml of oil to be tested in a tube 3 cm in diameter, heating the tube in a 300° F. bath for 90 minutes, and then cooling the oil. The oil is then filtered using a micropore filter with a number 1 filter paper, the filter and the filter paper are washed with heptane, and the residue remaining is compared with standard samples to determine the stability rating. If a fuel has a Nalco rating exceeding 7, it may often be blended with other stocks or treated with economic levels of chemical additives to bring it into specification. This approach can be employed with the blended fuel product produced by the process of this invention as well.

In addition to management of the above criteria of stability and cetane number, Ramsbottom carbon content is an important quality specification for diesel fuels, since fuels high in Ramsbottom carbon cause fouling problems when used in diesel engines. In an acceptable diesel fuel, the Ramsbottom carbon content is preferably less than about 0.3 weight percent, as determined by the method disclosed in ASTM D 524, prior to addition of any nitrate additives for cetane improvement.

Nonfungible fuels also have commercial importance, such as dedicated uses for railroad engines and the like. In these applications, fuel specifications, for example, Ramsbottom carbon and stability can be greatly relaxed from those discussed above, such as permitting a Ramsbottom carbon content of, for example, about 1 to about 10%. For these cases, the present invention still finds important applicability at appropriately elevated levels of nitrogen added.

While not desiring to be bound by theory, it is currently believed that the complex process according to the present invention for upgrading diesel oils by contact with a nitrogenous treating agent probably involves nitrogen addition to paraffins, olefins, naphthenes and aromatics to form nitrates, esters, amines, azides, indoles and the like.

As indicated above, the process of this invention can be employed on an atmospheric gas oil fraction derived from liquid petroleum crude sources. Atmospheric gas oil is one component used in diesel oil blending, and may contain an off-specification sulfur content for use a diesel fuel. Typically, sulfur as a heteroatom is present as thiols, disulfides, sulfides, thiophenes, and mercaptans, and nitrogen is present as substituted pyridines and pyrroles, and other compounds. A typical analysis of atmospheric gas oils is set forth in Table 1 below.

TABLE 1

Properties of Atmospheric Gas Oil (AGO)

| | Stock X | Stock CC |
|---|---|---|
| Gravity, API | 34.0 | 37.6 |
| Sulfur, wt. % | 1.07 | 0.72 |
| Nitrogen, ppm | 200 | 150 |
| Cetane Number | 58 | 53 |
| D86 Distillation, °F. | | |
| start | 216 | 300 |
| 5% | 418 | 408 |
| 10% | 482 | 446 |
| 30% | 532 | 501 |
| 50% | 558 | 529 |
| 70% | 584 | 562 |
| 90% | 618 | 619 |
| 95% | 636 | — |

As can be seen from an examination of the analysis presented in Table 1, the atmospheric gas oils, Stock X and Stock CC, have a high sulfur content. For these stocks, a satisfactory cetane number, Ramsbottom carbon content and stability are present. If cetane enhancement were attempted by the process according to this invention, improvements in the important criterion of cetane number can be obtained while retaining satisfactory Ramsbottom carbon content and stability.

After the completion of the treatment of the diesel oil with the nitric acid in step (1) of the process of this invention, any unreacted nitrogenous treating agent is removed from the treated diesel fuel in step (2). Where excess nitrogenous treating agent is removed, this can be achieved by decanting of the residue phase, by contacting the treating diesel oil with water to dissolve out the unreacted nitrogenous treating agent, or by contacting with clay or alkali, e.g., using alkali pellets or an aqueous alkali solution. Suitable examples of alkali which can be employed as the aqueous solution include sodium hydroxide, potassium hydroxide, sodium carbonate, ammonium hydroxide, etc. A suitable concentration of alkali of about 0.05M to about 5M in a ratio by weight of about 1:1 to the treated diesel oil or equivalents thereto can be used.

The washing of the treated diesel oil in the water wash or the alkali wash can be achieved by simply mixing the diesel fuel obtained in step (1) with water or with the alkali. Any conventional means for achieving effective contact, such as co-current or countercurrent flow or a simple addition with agitation can be employed to remove the unreacted treating agent acid from the treated diesel oil.

In the next step of the process of this invention, the treated diesel fuel so obtained is then mixed with a diesel oil which has not been so treated, herein "untreated diesel oil", to produce a blended diesel fuel.

Examples of untreated diesel oils which can be used and mixed with the treated diesel fuel obtained in step (2) include any diesel oil with a boiling range of about 350° F. to about 700° F. While in the process of this invention, any untreated diesel oil as previously described can be blended with the treated diesel fuel obtained in step (2) above, it would be obvious to one skilled in the art that the properties of the untreated diesel oil to be blended must be taken into account such that when the blend product is produced, other specifications required for a commercial fuel, such as sulfur content, Ramsbottom carbon content, stability, and the like, are met.

In order to enhance the cetane number of the ultimate diesel fuel blend, the nitrogen content added into the blended diesel fuel comprising the mixture of the treated diesel fuel and the untreated diesel oil is carefully controlled in accordance with the following parameters.

Specifically, where the diesel oil feed to step (1) is obtained from virgin diesel oil stocks, such as atmospheric gas oil, the amount of nitrogen added into the blended diesel fuel is about 300 ppm nitrogen or less, generally 150 ppm or less, more generally 100 ppm or less.

Where the diesel oil feed to step (1) is obtained from a diesel oil from hydrotreated diesel oil stocks, such as an atmospheric gas oil treated with hydrogen in the presence of a catalyst at a temperature exceeding about 600° F. and a pressure exceeding about 500 psi, the amount of nitrogen added into the diesel fuel blend is about 450 ppm nitrogen or less, generally 300 ppm nitrogen or less, more generally 200 ppm or less. The minimum amount of treated diesel oil prepared in step (1) and (2) which is employed in the blended product produced in step (3) is at least about 5 ppm nitrogen added, whether the diesel oil stock treated in step (1) is from virgin diesel oil stocks or hydrotreated diesel oil stocks.

Where the blended diesel product is to be used as a nonfungible fuel, i.e., where the fuel is produced for a specific end use and thus adherence to normal specifications of a fungible commercial diesel fuel are not of concern, then the diesel oil feed to step (1) can be any refinery stock having appropriate properties such that when subjected to the process of this invention provides blends meeting nonfungible specifications in the final product blend. In this case, the nitrogen added due to the treated diesel oil in the blended product can be such that the diesel fuel blend contains about 1000 ppm or less or added nitrogen, generally 800 ppm or less of added nitrogen, more generally 600 ppm or less of added nitrogen Use of the treated diesel oil in the blend produced with more than the above described levels of nitrogen added to the blend results in the inability to meet the desired blended product specifications for a diesel fuel.

The diesel oil stocks used to which the present invention is applicable can vary widely, and specifically can contain initial nitrogen levels from as little as about 5 ppm up to levels of about 1000 ppm. Surprisingly, even though it is conventionally believed there is a relationship of cetane to nitrogen level of a fuel, it has not been found that as a result of this invention it is not the total nitrogen content of the product blend which is relevant to simultaneous control of cetane, Ramsbottom carbon, and stability of the fuel product. Without regard to the nitrogen content of the ultimate blend obtained, the amount of added nitrogen is the relevant parameter to be controlled. Added nitrogen is defined herein as the nitrogen content of the final blended product after step (3) less the nitrogen content of the untreated diesel oil stock used in step (3) before addition of treated diesel oil obtained from step (2).

Regarding the blendability of Ramsbottom carbon content, it must be recognized that ASTM procedures require that the fuel first be distilled, and the carbon measurement then be made on the 10% bottoms remaining (by pyrolysis). This is because the Ramsbottom carbon precursors are normally found in the bottom cut of the diesel fuel. By concentrating these precusors by distillation, the precision of the carbon measurement is greatly improved. If another low Ramsbottom stock is blended, Ramsbottom carbon is not necessarily reduced because that blend-stock is distilled out before carbon measurement. Blending a heavier stock with the high carbon content stock (so that the bottom 10% is relatively dilute in carbon-forming compounds) might be contemplated but this would violate the ASTM end point specifications on the diesel fuel. Furthermore, for nitrogenated stocks produced in the process of the present invention, the nitrogen compounds are known to be polymerization catalysts for carbon formation, so that small amounts produce significant Ramsbottom carbon even when diluted.

FIG. 1 shows the Ramsbottom carbon content of various blends resulting from step (3) of the process of the present invention as a function of nitrogen added. Even though Ramsbottom carbon does not normally follow predictable blending relationships, the products produced by the process of the present invention surprisingly follow a predictable blending rule based on added nitrogen. It is further surprising that this correlation is suitable for a wide variety of feed diesel oils under various acid-to-oil ratios used in the treatment of step (1).

Considering the background of stability of diesel oils, the mechanisms are not well known except in general terms. It is, however, recognized that trace levels of contaminants, such as nitrogen compounds, play an important role in sediment formation, often as catalysts. As a result, dilution of an unstable fuel by a stable fuel does not generally improve stability appreciably. Upon dilution by a stable fuel, there are still sufficient quantities of these initiators to cause stability problems. As a result, the conventional method to attack stability problems has been to use a range of antioxidants, with the choice of the appropriate antioxidants being selected empirically (governed by which mechanism is operative for a given stock). Unfortunately, for nitrogenated stocks, uneconomic levels of additives have been required in the past. Stability can now be achieved with the present invention without the necessity for use of conventional additives, although they may be present if desired.

Figure 2:
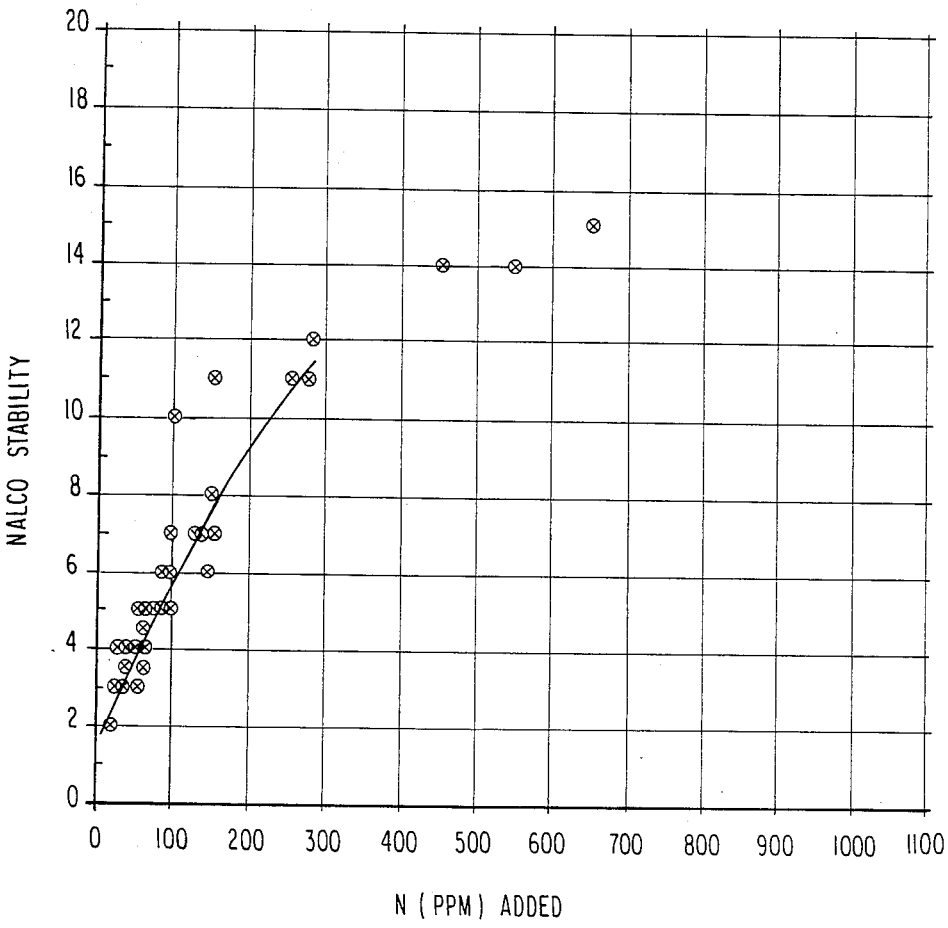
FIG. 2 is a graph showing the relationship between stability and nitrogen added to the blended diesel fuel.

FIG. 2 shows the stability of the blends resulting from step (3) of the process of the present invention as a function of nitrogen added. Even though stability does not normally follow predictable blending relationships, the products produced by the process of the present invention surprisingly follow a predictable blending rule using added nitrogen. Still further, in view of the usual lack of correlation between Ramsbottom carbon and stability, it is surprising that the added nitrogen parameter is suitable for both, as shown in both FIGS. 1 and 2.

Figure 3:
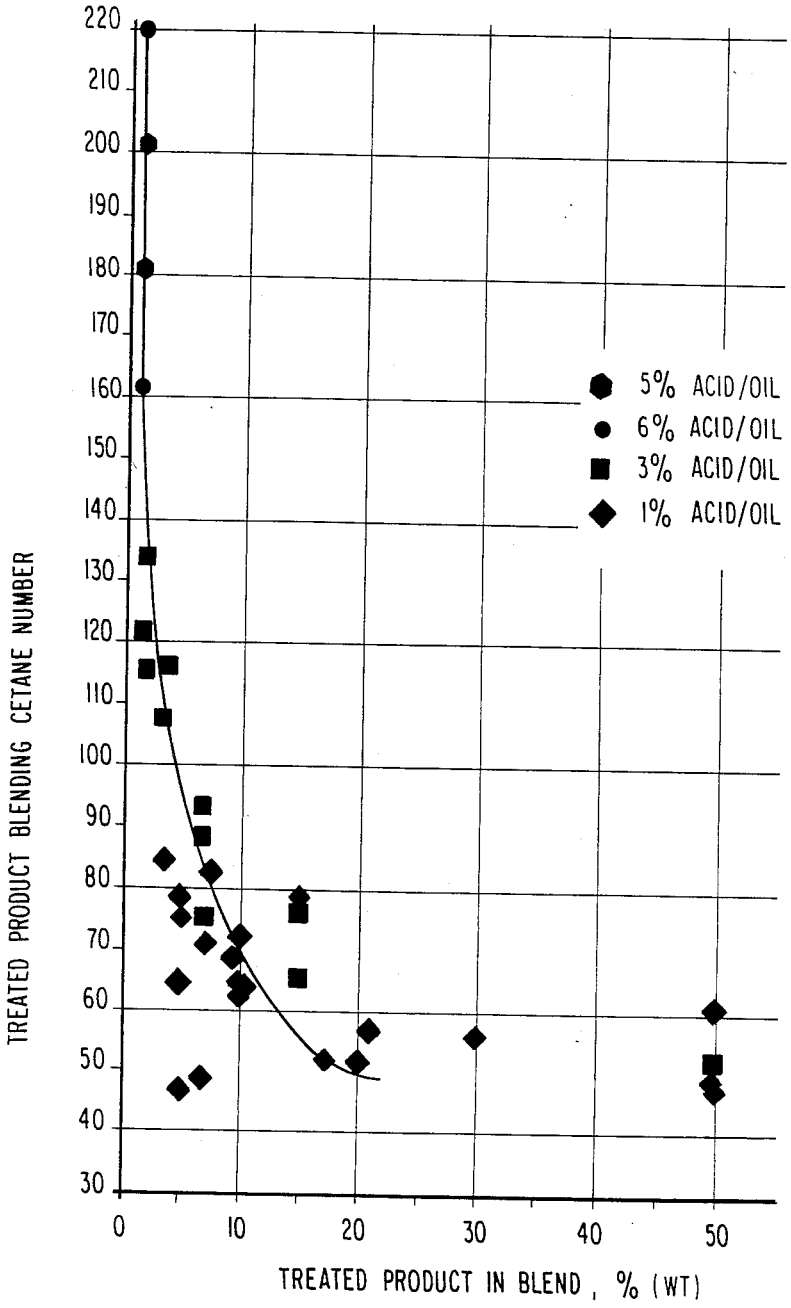
FIG. 3 is a graph showing the average blending cetane numbers of blended diesel fuel products for varying amounts of treated diesel fuel in the blend.

To obtain the data shown in FIGS. 1 and 2, the treated oil of step (2) was blended with an untreated oil to produce a blend product. Since the treated oil of step (2) contained nitrogen at levels of 2000 to 4000 ppm, the treated oil was employed in the blend at about 2% to 15% by weight of the total blend. The prior art has variously reported cetane number improvements of 5 to 20 numbers. In FIG. 3 are shown blending cetane numbers achieved from the present invention, generally corresponding to data with less than about 15% by weight treated oil in the blend. Since the diesel oil feed had a cetane number of about 40, the product oil of step (2) would be expected to have a cetane number of 45 to 60. Quite surprisingly, cetane numbers of 60 to 220 are achieved with this invention when blend proportions of less than 15% by weight of the oil obtained in step (2) are used in producing the blend product of step (3). However, it is to be emphasized the blend proportion used in FIG. 3 was employed only for purposes of illustration. Various other combinations of treating reactor variables and blend proportions to provide appropriate levels of added nitrogen as herein defined can be employed.

Figure 4:
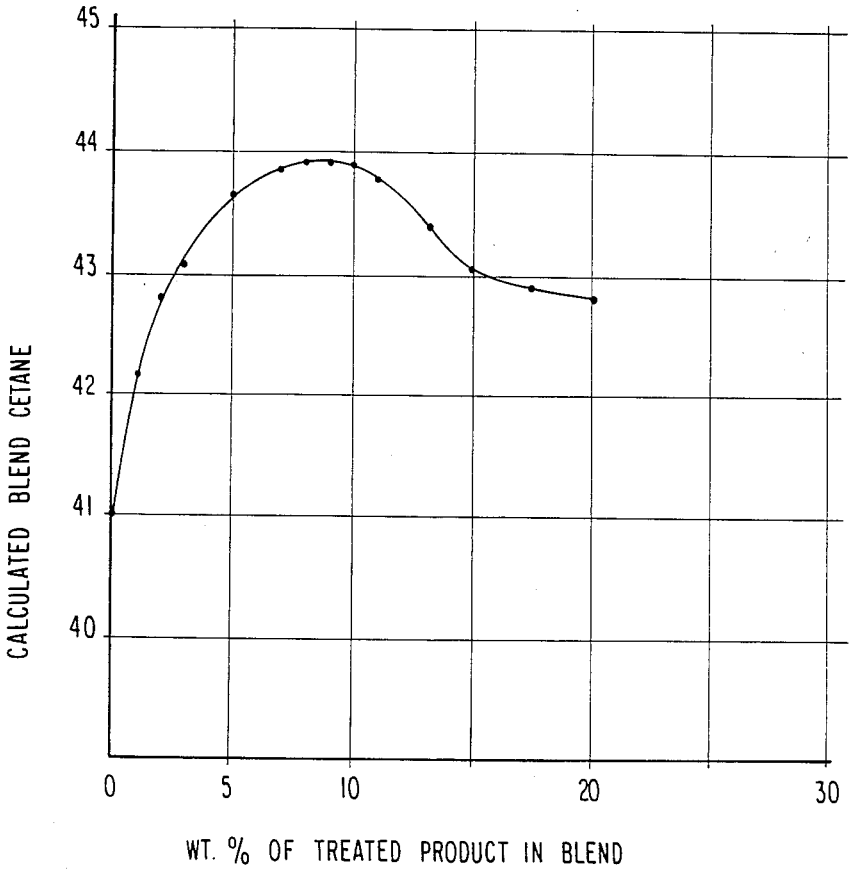
FIG. 4 is a graph showing the calculated pool cetane of blended diesel products produced using the process of this invention.

As will be discussed below, the line through the data of FIG. 3 may be used to describe the cetane number of oils produced in step (2) of the present invention. For these runs, this corresponds to blend proportions of less than 15% by weight. When the cetane of the final blend of product obtained in step (3) is calculated from the curve shown in FIG. 3 to eliminate scatter, the results of FIG. 4 are obtained. In view of the very small amounts of step (2) oil used, it is very surprising that a large improvement in cetane of the blended product of step (3) is achieved. In particular, a 3 cetane number increase in the blend produced in step (3) is obtained. Furthermore, it is particularly surprising that the maximum in the cetane curve resides in the blend region where carbon content and stability are simultaneously controlled.

FIGS. 1 through 4 indicate surprising and unobvious results, particularly by considering the weight of the combination of these effects. It is surprising that blends with added nitrogen having acceptable Ramsbottom carbon also provide blends of acceptable stability, with large cetane improvement and with a maximum cetane in regions of excellent stability and Ramsbottom carbon.

The treated diesel oil from step (1) can typically contain from 2000 to 4000 ppm nitrogen as shown in FIGS. 1 and 2. The measured cetane ratings of these treated oils were from 44 to 50, with an improvement over step (1) diesel oil feed (40 cetane) of 4 to 10 cetane numbers, similar to that which would be expected from the prior art. If the nitrogen added data of FIGS. 1 and 2 are considered for an untreated feed of 100 ppm nitrogen to step (3), simple calculations reveal that less than about 20% by weight and usually less than about 10% by weight of treated diesel oil can be accommodated in the blend. With such a low blend percentage of treated diesel oil, it would not be expected that the blended product from step (3) could have a cetane improvement beyond about 1 number based on conventional knowledge. Nevertheless, a surprisingly large cetane improvement was obtained.

Further, if the cetane is measured of the blended product of step (3), the blending cetane value of the step (2) diesel oil can be back-calculated from the well-known linear blending equation. The surprisingly large cetane improvement of the blend produced in step (3) leads to extremely large apparent blending cetane ratings for the diesel oil product obtained from step (2). Whereas conventionally, cetane improvements of the diesel oil product of steps (1) and (2) of about 10 cetane numbers might be predicted and such values were indeed measured for pure diesel oil product of step (1), the blending cetane values of the diesel oil product of steps (1) and (2) as shown in FIG. 3 are markedly increased.

With these dilute diesel blends, little cetane improvement would have been expected. As shown in FIG. 3, the effective cetane rating of the diesel oil product of step (2) used in the blend produced in step (3) becomes surprisingly large for these dilute blends. Not only do these blends meet Ramsbottom carbon and stability under the nitrogen added criteria of the present invention, but also the step (3) cetane level is maximized as shown in FIG. 4.

The blended diesel fuel obtained in accordance with the process of this invention can be used in any application wherein a diesel fuel meeting commercial specifications is desired. For example, the blended diesel fuel can be used for as fuel for automotive, motor truck, railroad or marine diesel uses.

The following example is given to illustrate the process of this invention in greater detail. However, the example is not to be construed as limiting the scope of the present invention but rather are given to merely illustrate the present invention. Unless otherwise indicated herein, all parts, percents, ratios and the like are by weight.

EXAMPLE

To provide the data of FIGS. 1 through 4, diesel oils were fed to a treating reactor, consisting of individual stocks selected from those shown in Table 2 for each run. These products were decanted to separate a residue phase as discussed below to produce a step (2) treated diesel oil. This oil was then blended with individual stocks A, B, or C selected from Table 2 to produce a blended diesel fuel from step (3). The designations in FIG. 1 show the nontreated diesel fuel used to blend with the treated diesel oil from step (2). Note that the treating reactor diesel oil feed, stocks A through G of Table 2, contained widely varying amounts of nitrogen.

In each one of the runs, about 500 grams of diesel oil was placed in a 1000 ml volume reactor which consisted of a beaker with a septum on the side. Nitric acid was used as the nitrogenous treating agent. The septum was about 1 inch from the bottom surface of the reactor for nitric acid injection. A measured quantity of 90% nitric acid (5.5 g for 0.01 A/O, 16.5 g for 0.03 A/O, 2.75 for 0.05 A/O, and 33 g for 0.06 A/O) was placed in a syringe and mounted on an injection pump. Here, A/O designates the acid to oil weight ratio used. The oil was stirred with a lab size stirrer at 1000 RPM. The temperature of the mixture was controlled at specific levels between 25° C. and 80° C. for these runs. Acid was injected over a 30 minute period. After the acid injection, the reaction mixture was further stirred for an additional 30 minutes to ensure consumption of residual acid in the mixture. At the completion of the treatment, the oil was separated from the residue formed by simple decantation. The separated oil was weighed, water washed and filtered. A specified amount of oil was blended with one of the untreated diesel oils shown in Table 2. Depending on the A/O ratio and treatment temperature used, different percent blends were made to be able to generate the relationships among variables shown in FIGS. 1 to 3. Samples of the blended products were analyzed for cetane number (ASTM D613), Ramsbottom carbon (ASTM D524), and Nalco stability. With 0.01 A/O ratio usually the nitrogen content of the treated oil is about 1500 to 2000 ppm; with A/O=0.03 the nitrogen content of the treated oil is about 3000 to 4000 ppm and for A/O=0.05 the nitrogen content of treated oil is about 5000 to 6000 ppm. With A/O=0.01, 5 to 10 percent blends were made (N added=75–150 ppm). With A/O=0.03, 3 to 5 percent blends were made (N added=100–150 ppm) and with A/O=0.06, 1 to 2 percent blends were made (N added=60–120 ppm) The results obtained are shown graphically in FIGS. 1 to 3.

TABLE 2

| | Properties of Various Diesel Oil Stocks | | | | | | |
|---|---|---|---|---|---|---|---|
| | Straight Run Diesel | | | Low Pressure Hydrotreated | Moderate Pressure Hydrotreated | | High Pressure Hydrotreated |
| | E | F | G | C | A | B | D |
| Gravity, API | 34.6 | 37.6 | 32.4 | 38.8 | 36.3 | 34.2 | 30.8 |
| Sulfur, wt % | 1.07 | 0.72 | 1.08 | 0.09 | 0.60 | 0.46 | 0.0 |
| Nitrogen, ppm | 200 | 150 | 93 | 96 | 191 | 256 | 87 |
| Ramsbottom carbon % | 0.129 | 0.144 | 0.139 | 0.122 | 0.111 | 0.105 | 0.107 |
| Nalco | — | — | 2 | 4 | 1 | 2 | 2 |
| Cetane Number | 58 | 53 | 48 | 39.2 | 41.7 | 41 | 38.8 |
| D86 Distillation, °F. | | | | | | | |
| Start | 216 | 300 | 270 | 405 | 250 | | 380 |
| 5% | 418 | 408 | 440 | 418 | 380 | | 410 |
| 10% | 482 | 446 | 468 | 440 | 395 | | 426 |
| 30% | 532 | 501 | 520 | 485 | 450 | | 480 |
| 50% | 558 | 529 | 550 | 508 | 490 | | 519 |
| 70% | 584 | 562 | 580 | 558 | 540 | | 550 |
| 90% | 618 | 619 | 640 | 619 | 600 | | 610 |
| 95% | 636 | — | — | 645 | 640 | | 635 |

While the invention has been described in detail and with reference to specific embodiments thereof, it will be apparent to one skilled in the art that various changes of modifications can be made therein with departing from the scope and spirit thereof.

What is claimed is:

1. A process for enhancement of the cetane number of a diesel fuel comprising:

(1) treating a diesel oil with a nitrogenous treating agent in a nitrogen amount, equivalent on a 100% nitric acid basis, of about 10 weight percent or less of the diesel oil feed;

(2) removing unreacted nitrogenous treating agent from the diesel oil of step (1) to produce a treated diesel oil; and (3) blending the treated diesel oil of step (2) with an untreated diesel oil to produce a blended diesel fuel such that the added nitrogen content in the blended diesel fuel is (a) about 300 ppm or less when the diesel oil treated in step (1) is obtained from virgin diesel oil stock; or (b) about 450 ppm or less of nitrogen added when the diesel oil treated in step (1) is obtained from hydrotreated diesel oil stock.

2. The process of claim 1, wherein said nitrogenous treating agent is a gaseous nitrogenous treating agent.

3. The process of claim 1, wherein said nitrogenous treating agent is a liquid nitrogenous treating agent.

4. The process of claim 2, wherein said gaseous nitrogenous treating agent is $NO_2$ or $N_2O_4$.

5. The process of claim 3, wherein said liquid nitrogenous treating agent is an aqueous solution of nitric acid.

6. The process of claim 5, wherein the nitric acid is an aqueous solution or nitric acid containing up to about 90% by weight water.

7. The process of claim 3, wherein the liquid nitrogenous treating agent is liquid $NO_2$ or $N_2O_4$.

8. The process of claim 1, wherein said step (1) and/or step (2) is conducted in the presence of an organic acid.

9. The process of claim 8, wherein said organic acid is acetic acid or formic acid.

10. The process of claim 1, wherein said treatment step (1) is conducted in the presence of an inorganic acid.

11. The process of claim 10, wherein said inorganic acid is sulfuric acid or phosphoric acid.

12. The process of claim 1, wherein the weight ratio of said nitrogenous treating agent, in an amount equivalent on a 100% nitric acid basis, to said diesel oil feed of step (1), is of about 0.0002 to about 0.1.

13. The process of claim 1, wherein the weight ratio of said nitrogenous treating agent, in an amount equivalent on a 100% nitric acid basis, to said diesel oil feed of step (1), is of about 0.0005 to about 0.05.

14. The process of claim 1, wherein the removing of the excess nitrogenous treating agent is by decanting.

15. The process of claim 1, wherein the removing of the unreacted nitrogenous treating agent is by water washing.

16. The process of claim 1, wherein the removing of the unreacted nitrogenous treating agent is by washing with alkali.

17. The process of claim 1, wherein the removing of the unreacted nitrogenous treating agent is by treatment with clay.

18. The process of claim 1, wherein said blended diesel fuel obtained is a fuel meeting specifications for automotive diesel use.

19. The process of claim 1, wherein said blended diesel fuel obtained is a fuel meeting specifications for railroad diesel use.

20. The process of claim 1, wherein said blended diesel fuel obtained is a fuel meeting specifications for motor truck diesel use.

21. The process of claim 1, wherein said blended diesel fuel obtained is a fuel meeting specifications for marine diesel use.

22. A process for the enhancement of the cetane number of a non-fungible diesel fuel comprising (1) treating a first diesel oil with a nitrogenous treating agent in a nitrogen amount, equivalent on a 100% nitric acid basis, of about 10 weight percent or less of the diesel oil feed;

(2) removing unreacted nitrogenous treating agent from the diesel oil of step (1); and (3) blending the treated diesel oil of step (2) with a second diesel oil which has not been treated as in step (1) above to produce a blended diesel fuel such that the added nitrogen content in the blended diesel fuel is about 1000 ppm or less and wherein the first diesel oil treated in step (1) and/or the second diesel oil blended in step (3) is a non-fungible diesel fuel.

23. The process of claim 22, wherein said nitrogenous treating agent is a gaseous nitrogenous treating agent.

24. The process of claim 22, wherein said nitrogenous treating agent is a liquid nitrogenous treating agent.

25. The process of claim 23, wherein said gaseous nitrogenous treating agent is $NO_2$ or $N_2O_4$.

26. The process of claim 24, wherein said liquid nitrogenous treating agent is an aqueous solution of nitric acid.

27. The process of claim 26, wherein the nitric acid is an aqueous solution of nitric acid containing up to about 90% by weight water.

28. The process of claim 24, wherein said liquid nitrogenous treating agent is liquid $NO_2$ or $N_2O_4$.

29. The process of claim 22, wherein said step (1) and/or step (2) is conducted in the presence of an organic acid.

30. The process of claim 29, wherein said organic acid is acetic acid or formic acid.

31. The process of claim 22, wherein said treatment step (1) is conducted in the presence of an inorganic acid.

32. The process of claim 31, wherein said inorganic acid is sulfuric acid or phosphoric acid.

33. The process of claim 22, wherein the weight ratio of said nitrogenous treating agent, in an amount equivalent on a 100% nitric acid basis to said diesel oil feed of step (1), is of about 0.0002 to about 0.1.

34. The process of claim 22, wherein the weight ratio of said nitrogenous treating agent, in an amount equivalent on a 100% nitric acid basis to said diesel oil feed to step (1), is of about 0.0005 to about 0.05.

35. The process of claim 22, wherein the removing of the unreacted nitrogenous treating agent is by decanting.

36. The process of claim 22, wherein the removing of the unreacted nitrogenous treating agent is by water washing.

37. The process of claim 22, wherein the removing of the excess nitrogenous treating agent is by washing with alkali.

38. The process of claim 22, wherein the removing of the excess nitrogeneous treating agent is by treatment with clay.

* * * * *